US008412394B2

(12) United States Patent
DeSanzo

(10) Patent No.: US 8,412,394 B2
(45) Date of Patent: Apr. 2, 2013

(54) RAILROAD SIGNAL MESSAGE SYSTEM AND METHOD

(75) Inventor: David Joseph DeSanzo, Waterford, PA (US)

(73) Assignee: General Electric Company, Schenectady, NY (US)

( * ) Notice: Subject to any disclaimer, the term of this patent is extended or adjusted under 35 U.S.C. 154(b) by 1000 days.

(21) Appl. No.: 12/276,039

(22) Filed: Nov. 21, 2008

(65) Prior Publication Data

US 2010/0131127 A1 May 27, 2010

(51) Int. Cl.
*B61L 25/02* (2006.01)

(52) U.S. Cl. ..... 701/19; 246/124

(58) Field of Classification Search ..... 701/19, 701/36; 246/14, 122 R, 124, 176, 217
See application file for complete search history.

(56) References Cited

U.S. PATENT DOCUMENTS 4,428,052 A * 1/1984 Robinson et al. ..... 701/117
4,885,689 A 12/1989 Kane et al.
5,267,318 A 11/1993 Severson et al.
7,096,096 B2 8/2006 Kane et al.
7,131,614 B2 * 11/2006 Kisak et al. ..... 246/167 R
7,222,003 B2 5/2007 Stull et al.

OTHER PUBLICATIONS

Nishibori, Development of Tracking Train Detection Device (COMBAT) by Using Wireless Communication, Railroad Conference, 2001. Proceedings of the 2001 IEEE/ASME Joint; pp. 161-170.

* cited by examiner

*Primary Examiner* — S. Joseph Morano
*Assistant Examiner* — Zachary Kuhfuss
(74) *Attorney, Agent, or Firm* — Shawn McClintic; Alleman Hall McCoy Russell & Tuttle LLP

(57) ABSTRACT

A railroad signal message system is provided. The system includes: an input circuit to receive railroad data from a railroad signaling device, an aspect converter operatively coupled to the input circuit to convert the railroad data into a machine-readable message that includes an indication of the railroad signaling device, and a message translator operatively coupled to the aspect converter to translate the message into a human-perceivable message.

14 Claims, 3 Drawing Sheets

SIGNAL MESSAGE FORMAT 300

| RAILROAD NAME 302 | TYPE OF DEVICE/SIGNAL 304 | MILE POST/UNIQUE LOCATION IDENTIFIER 306 | TRACK NUMBER 308 | SIGNAL INDICATION/ ALERT/MESSAGE 310 |
|---|---|---|---|---|

RAILROAD SIGNAL MESSAGE SYSTEM AND METHOD

BACKGROUND

Railroad signaling devices are positioned at various locations along railroad tracks to provide information relating to the state of an upcoming stretch of track known as a block to locomotive operators. In particular, railroad signaling devices have aspects and indications that are interpreted by locomotive operators to adjust locomotive operation accordingly. The aspect specifies the type of railroad signaling device (e.g., absolute, permissive, etc.) and the indication specifies the state of the railroad signaling device (e.g., stop and stay, proceed, etc.). Typically, a railroad signaling device employs visual cues to present the aspect and the indication to a locomotive operator.

In one example, a color scheme is utilized to impart the status of a block to a locomotive operator with separate lights and lenses for each color, similar to that of road traffic signals. In another example, a light position scheme is utilized to impart the status of a block to a locomotive operator where the position of the lights, rather than their color, determines the meaning. In yet another example, a color-position scheme is utilized to impart the status of a block to a locomotive operator where the combination of color and position is used to determine the meaning.

However, due to the visual nature of all of these signal schemes, various situations may occur where the aspect and/or indication of a railroad signaling device is misinterpreted or missed completely. For example, a railroad signaling device may be misinterpreted due to poor visibility caused by weather conditions (e.g., fog, snow, rain, etc.), operator error caused by railroad personnel preoccupation, or the like. As another example, railroad signaling devices may be misinterpreted due to a lack of standardization. Railroad signal aspects/indications and physical signal types can vary greatly from one railroad company to another. Moreover, railroad signal aspects, indications, and physical signal types can vary greatly from one division to another within the same railroad company.

Furthermore, the issues associated with railroad signals that provide block status information visually may be compounded by the fact that railroad signals are located external to and uncoupled from the locomotive. This may create a distance limitation at which a locomotive operator may react to a block status that affects locomotive operation. Furthermore, upon passing a railroad signaling device, a locomotive operator has no way of knowing the status of a block in advance of the locomotive or the status of a block in behind the locomotive. Thus, in some situations, a collision may occur due to reverse movement of a locomotive resulting in the locomotive reentering a block.

BRIEF DESCRIPTION OF THE INVENTION

According to one embodiment, a railroad signal message system is described herein. For example, the system may include an input circuit to receive railroad data from a railroad signaling device. An aspect converter operatively couples to the input circuit to convert the railroad data into a machine-readable message that includes an indication of the railroad signaling device. A message converter operatively couples to the aspect converter to translate the machine-readable message into a human-perceivable message.

In one example, a human-perceivable message is a voice message that includes an indication of the railroad signaling device. By generating a voice message, audible speech is used to convey an aspect and/or indication of the railroad signaling device to railroad personnel without requiring visual cues. As such, misidentification of the railroad signal may be reduced or avoided. Accordingly, railroad signal information is conveyed to a locomotive operator in a clear manner that affords more time for adjustment of operation of the locomotive. This may result in reduced wear and tear of locomotive components and improved fuel economy performance.

The summary above introduces a selection of concepts in simplified form that are further described in the detailed description. It does not identify key or essential features of the claimed subject matter, the scope of which is defined by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The subject matter disclosed herein generally relates to railroad signaling devices utilized to provide railroad information. Embodiments of the invention may relate to systems and methods that may be utilized to convey railroad signal information to railroad personnel in real-time (or on demand). In some cases, the railroad information may be conveyed to railroad personnel through voice messages that include an indication of a railroad signal.

Figure 1:
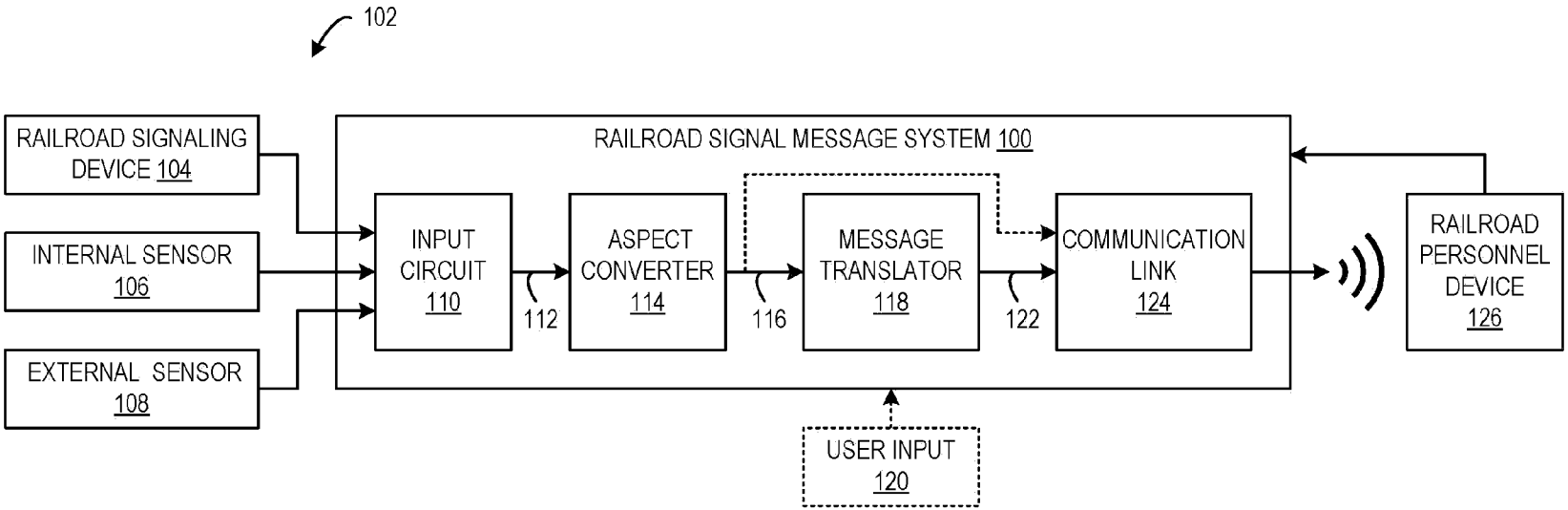
FIG. 1 is a schematic diagram of a railroad signal voice messaging system of the present disclosure.

FIG. 1 is a schematic diagram of an embodiment of a railroad signal message system 100 of the present disclosure. The railroad message system 100 includes an input circuit 110 that is configured to receive railroad data 102. In some embodiments, the input circuit 110 is a multi-channel input circuit that is configured to receive railroad data from a plurality of different sources. The railroad data 102 may be generated by different devices to provide railroad-block-status information and/or locomotive-operating information. In one example, the railroad data 102 is generated by a railroad signaling device 104 to provide status information of a block controlled by the railroad signaling device 104. The railroad signal message system 100 may receive railroad data from a railroad signaling device prior to the locomotive reaching the railroad signaling device or based on a predefined message trigger event.

In another example, the railroad data 102 is generated by an internal sensor 106 that is positioned on the locomotive. The internal sensor sends railroad data to the railroad message system 100 responsive to detection of a designated location/device, such as a railroad signaling device. The railroad data may provide an indication of a spatial relationship of the locomotive relative to the railroad signaling device.

In one example, an internal sensor is positioned at a front end of a first car of the locomotive to provide an indication of the position of the front end of the locomotive relative to a detected location/device. In particular, the sensor is positioned to provide an indication that the locomotive has entered a block based on detection of a railroad signaling device. In another example, an internal sensor is positioned at a rear end of a last car of the locomotive to provide an indication of the position of the rear end of the locomotive (e.g., the locomotive has exited the block). In some embodiments, a plurality of internal sensors are positioned at different portions of a locomotive to provide multiple indications of position of the locomotive relative to one or more detected locations/devices (e.g., a front car, a rear car, a first engine car, etc.).

In yet another example, the railroad data 102 is generated by an external sensor 108 based upon detection of a locomotive. In one example, the external sensor 108 is incorporated into a railroad signaling device and is a multi-channel sensor that sends railroad data to different sources (e.g., locomotive, railroad personnel, etc.). Accordingly, the external sensor sends railroad data to different sources based upon detection of a locomotive passing the railroad signaling device. In some cases, the railroad data generated by the external sensor 108 is transmitted to other railroad signaling devices or railroad signal message systems of different locomotives to provide updated railroad-block-status information based upon detection of a locomotive. For example, the external sensor 108 of a railroad signaling device may send an electrical signal indicating that a locomotive has entered or exited a block controlled by the railroad signaling device.

Continuing with FIG. 1, the input circuit 110 may receive railroad data 102 from a source, such as the ones described above, in various ways. In some embodiments, the railroad data 102 is received through a radio signal that is transmitted to the railroad signal message system 100. In some embodiments, the railroad data 102 is received through an electrical signal passed through a transmission line to the railroad signal message system 100. In this case, the input circuit 110 adjusts a voltage of a received electrical signal to a suitable level and format. The railroad data (or adjusted electrical signal) 112 output by the input circuit 110 is fed to an aspect converter 114.

The aspect converter 114 processes the adjusted electrical signal 112 (or railroad data) and converts it in to a message 116 having a predefined format, an example of which is discussed in further detail below with reference to FIG. 3. In some embodiments, the message 116 is machine-readable. That is, the message is comprehendible by a computing or processing device. The aspect converter 114 is programmable to recognize railroad signal aspects and indications as well as other railroad-status information in railroad data generated by railroad signaling devices from any suitable railroad company, region, country, etc. In one example, the aspect converter 114 includes lookup tables from which railroad signal aspects and/or indications are retrieved according to the electrical signal.

The message 116 output by the aspect converter 114 is sent to a message translator 118. The message translator 118 translates the machine-readable message 116 into a human-perceivable message 122. The human-perceivable message 122 includes the railroad-status information that is ordered according to the predetermined format of the message 116. In some embodiments, the message translator includes a voice synthesizer and the human-perceivable message includes a voice message. In some embodiments, the message translator includes a display and the human-perceivable message includes text or other visual representations of the railroad information (e.g., railroad signal aspects and indications) that are presented on the display. In some embodiments, a human-perceivable message includes both audio and visual indications of railroad information.

In some embodiments, the message translator 118 includes a multilingual voice synthesizer to generate a voice message from the machine-readable message in a language designated by user input 120 entered at the railroad message system 100. For example, a voice message may be generated in one of a plurality of selectable languages that is set by the user input. (For this purpose, the multilingual voice synthesizer includes data for each of a plurality of designated languages, and functionality for converting received machine-readable messages into voice messages in any of the designated languages.) By making the voice message available in a variety of languages, railroad-status information may be conveyed to railroad personnel regardless of their native language. In some cases, the user input 120 designates multiple languages in which the voice message is generated. In some embodiments, the railroad data 102 includes a language field in the predefined format that designates a language in which to generate the voice message. Further, in some embodiments, user input 120 specifies a language or alphabet in which text of a human-perceivable message is displayed. In another embodiment, the multilingual voice synthesizer includes a default mode. In the default mode (that is, an initial mode of operation), a default language of the multilingual voice synthesizer is based on a geographic location of the locomotive or other rail vehicle, as determined from sensors 106, 108 or other sensors/systems such as a GPS-based (global positioning system) locator device on the locomotive. The default language may be, for example, the predominate language used in the geographic region. The default mode may include plural default languages, for geographic areas where there is more than one predominate language. For example, if the position of a locomotive was determined to be in Canada, then the multilingual voice synthesizer could default to two languages, namely, French and English. Upon receiving a machine-readable message, the multilingual voice synthesizer would generate a first voice message in the first language (French) and a second voice message in the second language (English). If it was desired to change from default mode, a user could select a particular language through the user input 120, whereby subsequently-generated voice messages would be in the selected language. The user input 120 and/or message translator 118 may include a display device for displaying the languages available in the multilingual voice synthesizer to a user for selection (e.g., touch screen).

In some cases, the human-perceivable message 122 is generated based on a message trigger event (e.g., an ad hoc request for railroad-status information). Message trigger events will be discussed in further detail below with reference to FIG. 4.

The human-perceivable message 122, output by the message translator 118, is sent to communication link 124. The human-perceivable message 122 is received by the communication link and is transmitted for reception by a railroad personnel device 126. The communication link 124 may transmit the human-perceivable message 122 utilizing wired or wireless technologies. For example, the railroad personnel device 126 may include an on-board device, located in engine cars other than where the railroad signal message system is located and the human-perceivable message is transmitted through a wired connection. As another example, the railroad personnel device 126 may include an off-board device, such as a personal radio transceiver device located at a railroad crossing or a bridge. In some embodiments, the communication link 124 includes speakers to transmit a voice message locally in an audible manner.

Furthermore, in some embodiments, the railroad signal message system 100 transmits a human-perceivable message to the railroad personnel device 126 based on receiving a request from the railroad personnel device 126 or from another device. In one example, the railroad signal message system 100 transmits a human-perceivable message generated based on the most recently received railroad data. In another example, the railroad signal message system 100 transmits a human-perceivable message generated based on a particular type of railroad data such as a position of a locomotive as detected by a sensor.

In some embodiments, the machine-readable message output by the aspect converter 114 is transmitted by the communication link 124 to other railroad signal message devices and/or railroad signaling devices instead of, or in addition to, the human-perceivable message. The transmitted machine-readable message may be used to update railroad information such as a block status, or locomotive position. For example, a machine-readable message may be transmitted to a railroad signaling device responsive to a locomotive fouling a block to update the indication of the railroad signaling device.

Figures 2, 3:
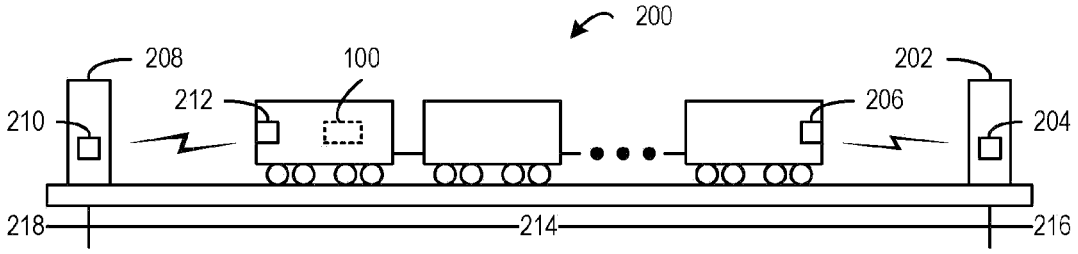
FIG. 2 is a schematic diagram of a locomotive interfacing with railroad signaling devices of a block.
FIG. 3 is a diagram of a predefined format for a voice message.

FIG. 2 is a schematic depiction of a locomotive 200 interfacing with a first railroad signaling device 202 and a second railroad signaling device 208 of block 214. Railroad-block-status information and locomotive-position information may be shared between the locomotive and the railroad signaling devices. In this example, assume that the locomotive 200 enters the block 214 from a block 216 to the right of block 214. Prior to entering the block 214, the railroad message system 100 of the locomotive 200 receives railroad data from the first railroad signaling device 202 that provides an indication of the status of the block 214 so that operation of the locomotive 200 may be adjusted accordingly. Further, upon passing the first railroad signaling device 202, a first internal sensor 212 of the locomotive 200 detects the first railroad signaling device 202 and generates railroad data that is sent to the railroad signal message system 100. The railroad signal message system 100 generates and transmits a human-perceivable (or machine-readable) message indicating that the status of the block 214 has changed, namely that the locomotive 200 has entered the block 214. Likewise, upon detection of the first end of the locomotive 200 by a first external sensor 204 of the first railroad signaling device 202, the first railroad signaling device 202 transmits railroad data with the updated indication of the status of the block 214. The railroad data is received by railroad signal message systems of locomotives in advance of, or in rear of, the block 214 and operation of these locomotives may be adjusted accordingly.

Upon detection of the first railroad signaling device 202 by a second internal sensor 206 of the locomotive 200, the second internal sensor 206 transmits railroad data to the railroad message system 100. The railroad message system 100 generates and transmits a human-perceivable (or machine readable) message indicating that the locomotive 200 has exited the block 216 and resides in the block 214. Likewise, upon detection of the second end of the locomotive 200 by the first external sensor 204 of the first railroad signaling device 202, the first railroad signaling device 202 transmits railroad data with the updated indication of the status of the block 216. The railroad data is received by railroad signal message systems of locomotives in advance of, or in rear of, the block 216 and operation of these locomotives may be adjusted accordingly.

Upon detection of the second railroad signaling device 208, the first internal sensor 212 of the locomotive 200 transmits railroad data to the railroad message system 100. The rail road message system 100 generates and transmits a human-perceivable (or machine-readable) message indicating that the locomotive 200 has entered a block 218. Likewise, upon detection of the first end of the locomotive 200 by a second external sensor 210 of the second railroad signaling device 208, the second railroad signaling device 208 transmits railroad data with the updated indication of the status of the block 218. The railroad data is received by railroad signal message systems of locomotives in advance of, or in rear of, the block 218 and operation of these locomotives may be adjusted accordingly.

Upon detection of the second railroad signaling device 208, the second internal sensor 206 of the locomotive 200 transmits railroad data to the railroad message system 100. The rail road message system 100 generates and transmits a signal human-perceivable (or machine-readable) message indicating that the locomotive 200 has exited the block 214. Likewise, upon detection of the rear end the locomotive 200 by the second external sensor 210 of the second railroad signaling device 208, the second railroad signaling device 208 transmits railroad data with the updated indication of the status of the block 214. The railroad data may be received by railroad signal message systems of locomotives in advance of, or in rear of, the block 214 and operation of these locomotives may be adjusted accordingly.

In the event that the locomotive 200 performs a reverse operation, when residing in the block 214, that causes the locomotive to foul block 216, the second internal sensor 206 detects the first railroad signaling device 202 and sends railroad data to the railroad message system 100. The railroad message system 100 generates a human-perceivable (or machine-readable) message that indicates that an end of the locomotive has passed the railroad signal and has entered the block 216. Likewise, upon detection of the rear end the locomotive 200 by the first external sensor 204 of the first railroad signaling device 202, the first railroad signal 202 transmits an electrical signal with the updated indication of the status of the block 216. Accordingly, the railroad personnel of the locomotive 200 that has fouled the block, as well as railroad personnel of a pursuing locomotive, may be informed of this condition so that operation may be adjusted accordingly.

In some embodiments, one or more of the above described sensors may be omitted. In some embodiments, one or more additional sensors may be positioned on the locomotive 200 or at a location within block 214.

FIG. 3 shows an embodiment of a signal message format 300 that indicates the status of a railroad signaling device or other suitable railroad information, such as a locomotive position. The signal message format 300 includes specific information fields that are organized according to a predefined order in the railroad signal message system to convert electrical signals or railroad data received from railroad signals or other sensors. In one example, lookup tables are utilized to convert railroad data in to a message. For example, the aspect converter 114 identifies a value in the railroad data for each field of the signal message format and retrieves a lookup table entry corresponding to that value for each field to populate the message.

The signal message format 300 includes different fields that correspond to different pieces of information relating to a block, railroad signal, or locomotive location. In particular, signal message format 300 includes a railroad name field 302, a type of device/signal aspect field 304, a mile post/location identifier field 306, a track number field 308, and a signal indication/alert/message field 310. The railroad name field 302 identifies the name of the railroad that operates or controls the block for which the railroad data is generated. The type of device/signal aspect field 304 identifies the particular type of railroad signaling device, device aspect, or other signal device that generates railroad data. Non-limiting examples of device types and/or signal aspects include a railroad crossing signal, a bridge crossing signal, a switch-back signal, a sensor, a transceiver device, etc. The mile post/location identifier field 306 identifies a mile post marker or a location such as a landmark, a body of water, a city, street, address, or other suitable location. The track number field 308 identifies the number assigned to the block of track for which the railroad data is generated. The signal indication/alert/message field 310 identifies the indication or state of a railroad signaling device, more particularly, the state of a block controlled by the railroad signaling device and/or instructions for proceeding through the block. Non-limiting examples of railroad signaling device indications include clear, stop and stay, stop and proceed, etc. In some cases, the signal indication/alert/message field 310 identifies an alert or message such as an updated railroad signaling device indication or locomotive position. For example, the signal indication/alert/message field 310 can include an alert indicating that reverse operation has caused the locomotive to foul the previous block. As another example, the signal indication/alert/message field 310 can include an alert indicating that a locomotive in advance of the locomotive receiving the railroad data has fouled the currently occupied or upcoming block.

Figure 4:
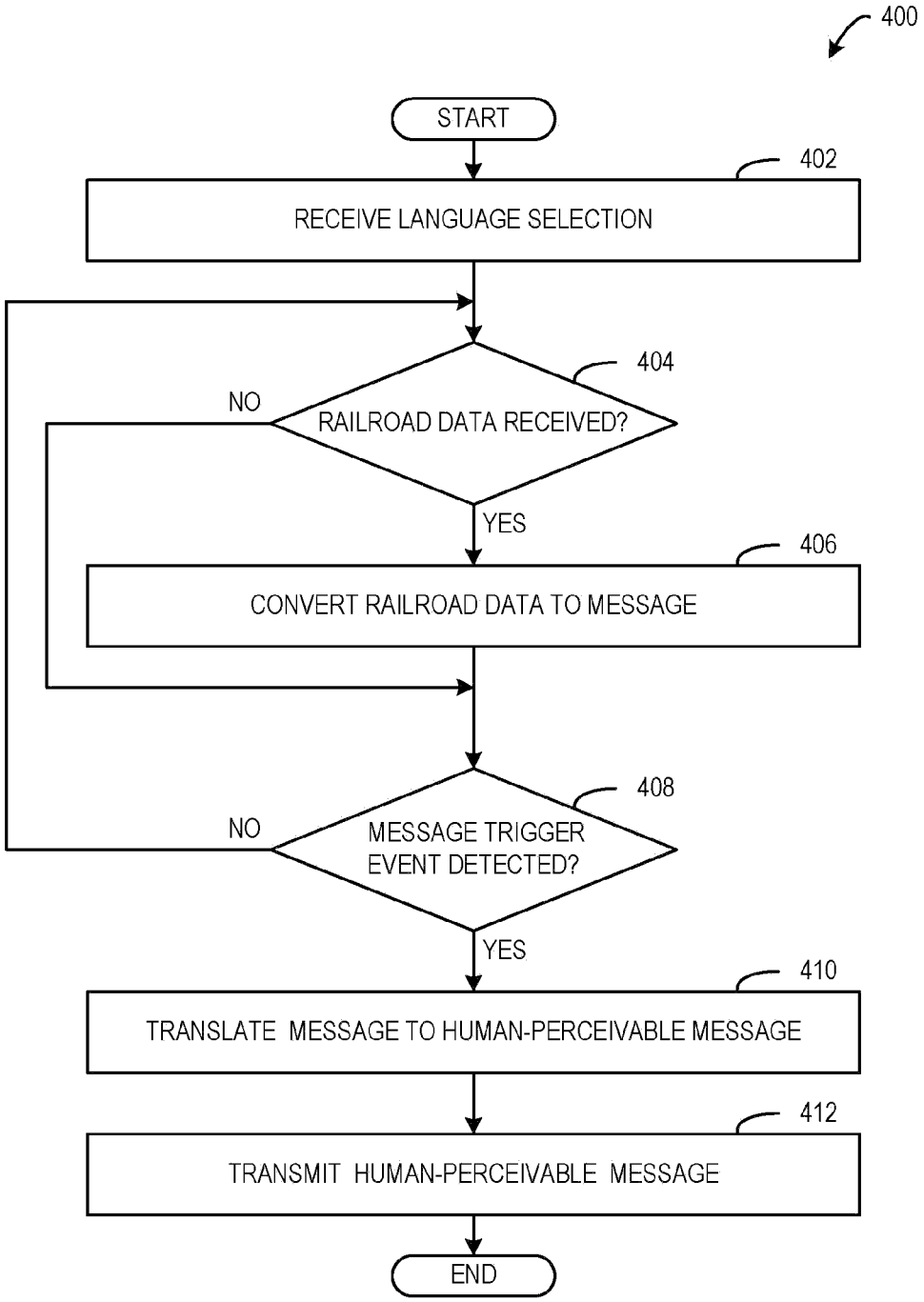
FIG. 4 is a flow diagram of a method for providing railroad information to a locomotive.

FIG. 4 is a flow diagram 400 of an example of a method for providing railroad information to a locomotive. The railroad information includes railroad signaling device information, locomotive position information, block status information, or the like. In one example, the method is executed by the railroad signal message system 100 described above and shown in FIG. 1. The flow diagram begins at 402, where the method includes receiving a language selection. The language selection is be used to generate a voice message in that language. In some embodiments, the language selection is one of a plurality of selectable languages that is set by user input to the railroad signal message system. In some embodiments, the language selection is included in railroad data that has been received. In some embodiments, the language selection includes an alphabet selection that may be utilized to generate a machine-readable message in the alphabet selection and/or generate a human-perceivable message for display in the alphabet selection. In some cases, an alphabet used for display of a human-perceivable message is determined from a language selection.

At 404, the method includes determining if railroad data is received. The railroad data may be received from a variety of different devices including railroad signaling devices, internal sensors, external sensors, railroad personnel devices, etc. If it is determined that railroad data is received, the method moves to 406. Otherwise, railroad data has not been received and the method moves to 408.

At 406, the method includes converting the railroad data into a message. As discussed above, in one example, the railroad data is converted by the aspect converter 114 of FIG. 1. The railroad data is converted according to a predefined format. In one example, the predefined format has different fields including a railroad name, a railroad signal type, a railroad signal location, a track number, and an indication. In some embodiments, the message is machine-readable or is generated in an alphabet of a language designated by a selection, as discussed above.

At 408, the method includes determining if a message trigger event has occurred. A message trigger event includes virtually any suitable event that causes a message to be generated or transmitted. Example message trigger events include receiving railroad data from a railroad signaling device, an internal sensor, an external sensor, and/or a railroad personnel device. More particularly, a message trigger event is caused by particular situations that cause railroad data to be transmitted, such as when a locomotive enters a block controlled by a railroad signaling device, when a locomotive enters a block not controlled by a railroad signaling device, when a front end of lead car passes a railroad signaling device, when a rear end of a last car of a locomotive passes a railroad signaling device, and/or when a predefined signal indication of a railroad signaling device is active, such as the most restrictive signal indication (e.g., stop and stay).

Furthermore, a message trigger event may be detected that causes a signal message to be retransmitted or updated. In one example, railroad data is received from a railroad personnel device that requests a message to be transmitted. As another example, a message is transmitted on a periodic basis such that each time an end of a predefined period is reached, the signal message is transmitted. In some embodiments, the most recently generated message is transmitted. In some embodiments, the railroad signal message system includes additional processing systems that update the fields of a message with the most recent railroad information based on operation of the locomotive. For example, the mile post/location identifier field of the message may be updated based on a speed of the train and time since receiving the electrical signal.

If it is determined that a message trigger event has occurred, the method moves to 410. Otherwise, a message trigger event has not occurred and the method returns to 404.

At 410, the method includes generating a human-perceivable message from the message. In the case where the human perceivable message is a voice message, the voice message is computer-generated speech that communicates the indication of a railroad signaling device, the position of a locomotive, and/or other railroad information, according to a predefined format. As discussed above, in one example the human-perceivable message is generated by the message translator 118 of FIG. 1.

At 412, the method includes transmitting the human-perceivable message (or the machine-readable message if the message is being sent to a railroad signaling device). The human-perceivable message is transmitted to railroad personnel devices to alert railroad personnel of the condition of a particular railroad signaling device or a locomotive. As discussed above, in one example, the human-perceivable message is transmitted by the communication link 124 of FIG. 1. The human-perceivable message may be transmitted through wired or wireless communication. The human-perceivable message is received by on-board devices so that railroad personnel of a locomotive may be alerted to the condition of a railroad signaling device. Further, the human-perceivable message is received by off-board devices so that other railroad personnel may be alerted to the position of a locomotive. In some cases, the machine-readable message is transmitted, such as to a railroad signaling device, to update railroad information based on a message triggering event.

In some embodiments, the method includes transmitting both audio and visual messages. Accordingly, the message are received as text in a display of a railroad personnel device and as speech played by a speaker of the railroad personnel device. Thus, railroad personnel are provided with an audio and a visual indication of a railroad signaling device. Because railroad information is provided to railroad personnel in multiple forms (i.e. audio and visual), the railroad information is comprehended quicker. This quicker comprehension results in additional time for railroad personnel to adjust locomotive operation resulting in better handling, reduced wear and tear on locomotive components, and improved fuel economy performance.

Note that the example control and estimation routines and/or methods included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system.

This written description uses examples to disclose the invention, including the best mode, and also to enable any person of ordinary skill in the art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A railroad signal message system for a rail vehicle, comprising:

an input circuit to receive railroad data from a railroad signaling device;

an aspect converter operatively coupled to the input circuit to convert the railroad data into a machine-readable message that includes an indication of the railroad signaling device, wherein the machine-readable message has a predefined format that includes a railroad name, a railroad signal type, a railroad signal location, a track number, and the indication; and a message translator operatively coupled to the aspect converter to translate the message into a human-perceivable message.

2. The system of claim 1, further comprising:

a communication link operatively coupled to the message translator to transmit the human-perceivable message.

3. The system of claim 1, further comprising:

an internal sensor configured to provide railroad position data to the input circuit responsive to detection of the railroad signaling device.

4. The system of claim 3, wherein the aspect converter is further configured to convert the railroad position data received from the internal sensor into a second message providing an indication of a spatial relationship of the rail vehicle relative to the railroad signaling device.

5. The system of claim 4, wherein the indication includes an alert that the rail vehicle has entered a previous block based on the internal sensor detecting the railroad signaling device for a second time.

6. The system of claim 1, wherein the input circuit is further configured to receive railroad data sent from an external sensor in response to detection of the rail vehicle.

7. The system of claim 1, wherein the input circuit receives the railroad data prior to the rail vehicle reaching the railroad signaling device.

8. The system of claim 1, wherein the indication includes an alert that a status of a block controlled by the railroad signaling device has changed.

9. The system of claim 1, wherein the message translator includes a voice synthesizer and the human-perceivable message is a voice message.

10. The system of claim 9, wherein the voice synthesizer is a multilingual voice synthesizer and the voice message is generated in one of a plurality of selectable languages that is set by user input to the railroad signal message system.

11. A railroad signal message system for a rail vehicle comprising:

an input circuit to receive railroad data from a railroad signaling device;

an aspect converter operatively coupled to the input circuit to convert the railroad data into a machine-readable message having a predefined format that includes an indication of the railroad signaling device; and a multilingual voice synthesizer operatively coupled to the aspect converter to translate the machine-readable message into a human-perceivable message responsive to a message trigger event that includes receiving railroad data at the aspect converter; and a communication link operatively coupled to the multilingual voice synthesizer to transmit the human-perceivable message.

12. A railroad signal message system for a locomotive rail vehicle, comprising:

an input circuit to receive railroad data from a railroad signaling device;

an internal sensor configured to provide railroad position data to the input circuit responsive to detection of the railroad signaling device;

an aspect converter operatively coupled to the input circuit to convert the railroad data into a machine-readable message that includes an indication of the railroad signaling device and convert the railroad position data received from the internal sensor into a second message providing an indication of a spatial relationship of the rail vehicle relative to the railroad signaling device that includes an alert that the rail vehicle has entered a previous block based on the internal sensor detecting the railroad signaling device for a second time; and a message translator operatively coupled to the aspect converter to translate the message into a human-perceivable message.

13. A railroad signal message system for a rail vehicle comprising:

an input circuit to receive railroad data from a railroad signaling device;

an aspect converter operatively coupled to the input circuit to convert the railroad data into a machine-readable message having a predefined format that includes an indication of the railroad signaling device; and a multilingual voice synthesizer operatively coupled to the aspect converter to translate the machine-readable message into a human-perceivable message responsive to a message trigger event that includes receiving a request to transmit the human-perceivable message; and a communication link operatively coupled to the multilingual voice synthesizer to transmit the human-perceivable message.

14. A railroad signal message system for a rail vehicle comprising:

an input circuit to receive railroad data from a railroad signaling device;

an aspect converter operatively coupled to the input circuit to convert the railroad data into a machine-readable message having a predefined format that includes an indication of the railroad signaling device; and a multilingual voice synthesizer operatively coupled to the aspect converter to translate the machine-readable message into a human-perceivable message responsive to a message trigger event that includes reaching an end of a predetermined period; and a communication link operatively coupled to the multilingual voice synthesizer to transmit the human-perceivable message.

* * * * *